US005744904A

United States Patent [19]

Chang-Fa

[11] Patent Number: 5,744,904

[45] Date of Patent: Apr. 28, 1998

[54] APPARATUS FOR REDUCING MAGNETIC FIELD RADIATED FROM DEFLECTION YOKE

[75] Inventor: Hsieh Chang-Fa, Taoyuan, Taiwan

[73] Assignee: Acer Peripherals, Inc., Taiwan

[21] Appl. No.: 715,280

[22] Filed: Sep. 16, 1996

[51] Int. Cl.[6] ..... H01J 31/00

[52] U.S. Cl. ..... 313/479; 313/440; 325/210; 325/213

[58] Field of Search ..... 313/479, 440, 313/477; 325/210, 213, 296, 299; 315/85; 348/820

[56] References Cited

U.S. PATENT DOCUMENTS

| | | | |
|---|---|---|---|
| 3,240,985 | 3/1966 | Ammerman et al. | 348/820 |
| 4,494,097 | 1/1985 | Lenders | 335/213 |
| 4,922,153 | 5/1990 | Kevius | 315/85 |
| 5,170,094 | 12/1992 | Giannantonio et al. | 313/440 |
| 5,200,673 | 4/1993 | Hishiki | 315/370 |

*Primary Examiner*—William L. Oen
*Assistant Examiner*—Max H. Noori

[57] ABSTRACT

An apparatus for reducing the leakage of the magnetic field from a deflection yoke without consumption of additional energy is provided. The apparatus includes a first circuit and a second circuit. The first circuit substantially loops around the upper portion of the funnel shaped C.R.T., defining a first space, and is connected to the ground reference. When the upper magnetic field generated from the deflection yoke passes through the first space, a first current of eddy current type is generated within the first circuit which, in turn, results in heat whereby the leakage of the magnetic field is reduced. The second circuit substantially loops around the lower portion of the funnel shaped C.R.T., defining a second space, and is connected to the ground reference. When the lower magnetic field generated from the deflection yoke passes through the second space, a second current of eddy current type is generated within the second circuit which, in turn, results in heat whereby the leakage of the magnetic field is reduced.

2 Claims, 1 Drawing Sheet

APPARATUS FOR REDUCING MAGNETIC FIELD RADIATED FROM DEFLECTION YOKE

BACKGROUND OF INVENTION

Figure 1:
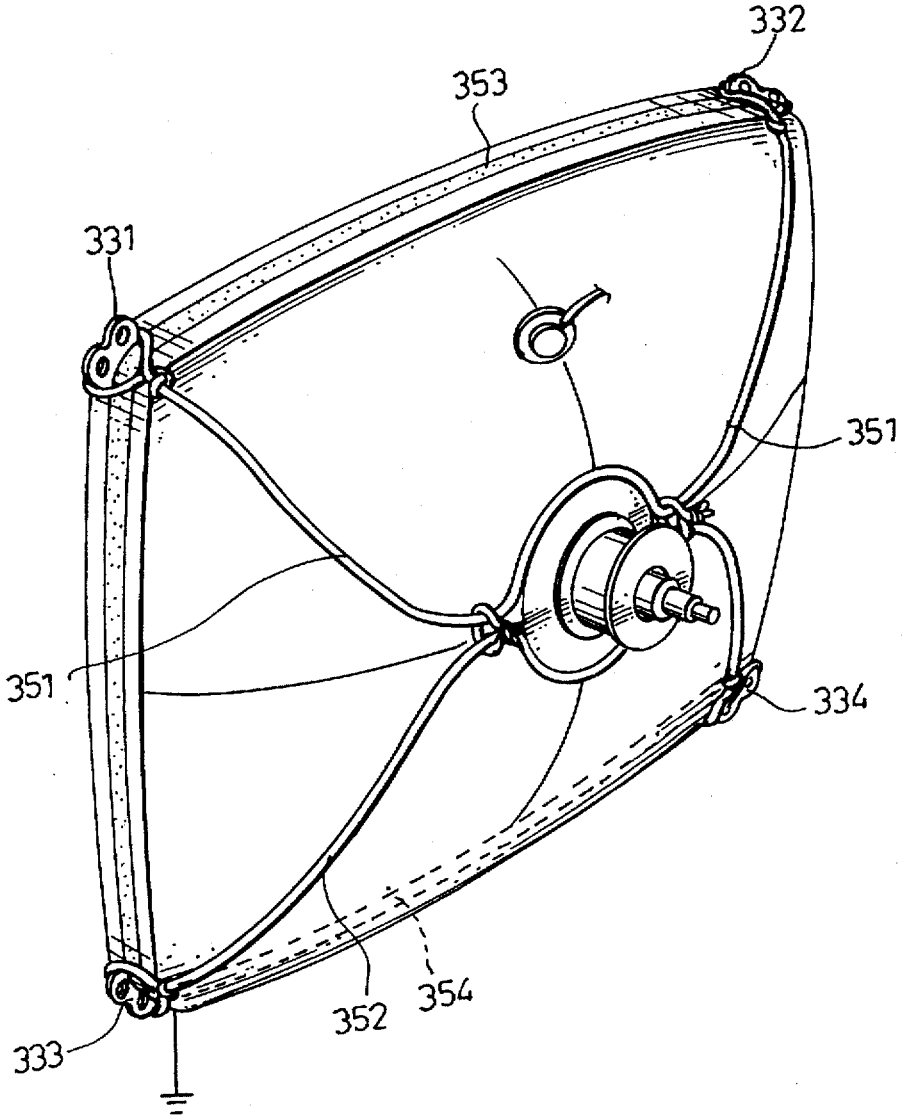

The present invention relates to apparatus reducing the magnetic field radiated from the deflection yoke of a cathode ray tube within a display device.

It is well known that a cathode ray tube (C.R.T.) utilizes a deflection yoke to generate a magnetic field which controls the locations of an electronic beam impinging on the inner surface of C.R.T. Therefore, in operation, leakage of the magnetic field from the deflection yoke is likely to happen, especially in the vertical plane.

To reduce the leakage mentioned above, typically, the manufacture of a C.R.T. implements a canceling coil cascaded to the horizontal deflection coil of the deflection yoke. The horizontal deflection current flowing through the canceling coil produces a counter magnetic field of adequate direction and magnitude to offset the leakage magnetic field. However, this conventional approach lowers the horizontal deflection sensitivity of the deflection yoke. If a minimum horizontal deflection sensitivity is required, more energy is required to drive the deflection yoke.

SUMMARY OF INVENTION

The present invention adopts a novel approach to reduce the leakage of the magnetic field from a deflection yoke without consumption of additional energy.

Another object of the present invention is to reduce the leakage of the magnetic field from the deflection yoke without lowering the horizontal deflection sensitivity of the deflection yoke.

The apparatus includes a first circuit and a second circuit. The first circuit substantially loops around the upper portion of the funnel shaped C.R.T. which defines a first space, and is connected to the ground reference. When the upper magnetic field generated from the deflection yoke passes through the first space, a first current is generated within the first circuit. The first current results in dissipated heat whereby the leakage of the magnetic field is reduced.

The second circuit substantially loops around the lower portion of the funnel shaped C.R.T. which defines a second space, and is connected to the ground reference. When the lower magnetic field generated from the deflection yoke passes through the second space, a second current is generated within the second circuit. The second current results in dissipated heat whereby the leakage of the magnetic field is reduced.

BRIEF DESCRIPTION OF THE APPENDED DRAWINGS

FIG. 1 depicts the embodiment of the invention coupled to the cathode ray tube.

DETAILED DESCRIPTIONS OF THE EMBODIMENT

As shown in FIG. 1, the apparatus of the invention includes a first insulated wire 351 looped substantially around the upper portion of the funnel shape of the cathode ray tube. The two ends of the wire 351 are naked, i.e. without the insulation material, and respectively connected to the lugs 331 and 332. The lugs 331 and 332 are connected to the conventional tension band 353 which is grounded. The wire

351, via the tension band 353, forms a grounded closed loop. As the upper half of magnetic field leakage radiated by the deflection yoke passes through the inner space defined by the wire loop 351, due to the result of Faraday's law, a current is therefore induced within the wire loop 351. Furthermore, since the deflection yoke functions to bias the direction of the electronic beam periodically, the leakage magnetic field varies accordingly and periodically. This periodically varied magnetic field leakage results in an induced current of an eddy current type. The eddy current generated within the wire loop 351, therefore, produces heat which dissipates through the surrounding air. In other words, the above mechanism consumes the leakage magnetic field by transforming it into the dissipated heat and achieves the purpose of the present invention. In the case of the loop wire 351 not being grounded, any interfering magnetic field from outside of the cathode ray tube may, via the ungrounded loop wire 351, influence the operation of the cathode ray tube. But the first wire loop 351 of the invention is arranged to connect to ground, via the tension band 353, so any interfering magnetic field from outside of the cathode ray tube does not influence the normal operation of the cathode ray tube.

In addition, the apparatus of the invention includes a second insulated wire 352 looped substantially around the lower portion of the funnel shape of the cathode ray tube. The two ends of the wire 352 are naked, i.e. without the insulation material, and respectively connected to the lugs 333 and 334. The lugs 333 and 334 are connected to the conventional tension band 354 which is grounded. The wire 352, via the tension band 354, forms a grounded closed loop. As the lower half of the magnetic field leakage radiated by deflection yoke passes through the space defined by the wire loop 352, due to the result of Faraday's law, a current is therefore induced within the wire loop 352. Furthermore, since the deflection yoke functions to bias the direction of the electronic beam periodically, the leakage magnetic field varies accordingly and periodically. This periodically varied magnetic field leakage results in an induced current of an eddy current type. The eddy current generated within the second wire loop 352, therefore, produces heat which dissipates through the surrounding air. In other words, the above mechanism consumes the leakage magnetic field by transforming it into the dissipated heat and achieves the purpose of the present invention. In the case of the loop wire 352 not being grounded, any interfering magnetic field from outside of the cathode ray tube may, via the ungrounded loop wire 352, influence the operation of the cathode ray tube. But the second wire loop 352 of the invention is arranged to connect to ground, via the tension band 354, so any interfering magnetic field from outside of the cathode ray tube does not influence the normal operation of the cathode ray tube.

What is claimed is:

1. An apparatus for reducing a magnetic field radiated from a deflection yoke, the deflection yoke being disposed around a neck portion of a cathode ray tube which is in the form of a funnel shape and which includes a lip portion, the funnel shape defining an upper portion and a lower portion with reference to the neck portion, the deflection yoke generating an upper magnetic field and a lower magnetic field, a first and a second lug being provided on the upper portion, a third and a fourth lug being provided on the lower portion, comprising:

a tension band surrounding the lip portion of the cathode ray tube, the first, second, third and fourth lugs respectively electrically contacting the tension band, the tension band being electrically grounded;

a first circuit path structure having first and second ends respectively connected to the first and second lugs, the first circuit path structure and the portion of the tension band between the first and second lugs providing a first circuit loop defining a first loop space, the upper magnetic field generating a first eddy current in the first circuit path structure by passing through the first loop space, the first eddy current resulting in dissipated heat;

a second circuit path structure having first and second ends respectively connected to the third and fourth lugs, the second circuit path structure and the portion of the tension band between the third and fourth lugs providing a second circuit loop defining a second loop space, the lower magnetic field generating a second eddy current in the second circuit path structure by passing through the second loop space, the second eddy current resulting in dissipated heat.

2. The apparatus as recited in claim 1, wherein:

the first circuit path structure comprises a first insulation wire having two naked ends respectively connected to the first and second lugs; and the second circuit path structure comprises a second insulation wire having two naked ends respectively connected to the third and fourth lugs.

* * * * *